United States Patent [19]

Cox et al.

[11] 4,046,440

[45] Sept. 6, 1977

[54] VENDOR WITH DOOR AND SHELF INTERLOCK

[75] Inventors: Robert N. Cox, Bridgeton; Melvin G. Grober, Mountain Grove, both of Mo.

[73] Assignee: UMC Industries, Inc., Stamford, Conn.

[21] Appl. No.: 676,215

[22] Filed: Apr. 12, 1976

Related U.S. Application Data

[63] Continuation of Ser. No. 511,986, Oct. 4, 1974, abandoned.

[51] Int. Cl.[2] ..... A47F 1/00; G07F 11/00

[52] U.S. Cl. ..... 312/215; 312/35; 312/218; 312/138 R; 221/75

[58] Field of Search ..... 312/138, 218, 220, 216, 312/35, 311, 273, 274, DIG. 32, DIG. 33; 221/75

[56] References Cited

U.S. PATENT DOCUMENTS

| | | | |
|---|---|---|---|
| 2,095,811 | 10/1937 | Goulooze | 312/274 |
| 3,344,953 | 10/1967 | Krakauer et al. | 221/75 |
| 3,466,108 | 9/1969 | Guth | 312/311 |
| 3,575,480 | 4/1971 | Peisker | 312/218 |
| 3,653,540 | 4/1972 | Offutt | 221/75 |
| 3,752,546 | 8/1973 | O'Neal | 312/138 |
| 3,843,223 | 10/1974 | Schneider | 312/274 |

*Primary Examiner*—Paul R. Gilliam
*Assistant Examiner*—Victor N. Sakran
*Attorney, Agent, or Firm*—Koenig, Senniger, Powers and Leavitt

[57] ABSTRACT

A vendor comprising a cabinet having a front door and shelves in the cabinet for holding items to be vended, the shelves being slidable into and out of the cabinet at the front of the cabinet when the door is open, the vendor having means for locking the shelves in the cabinet unless the door is opened far enough to enable the shelves to be slid out without striking the door, and means for locking the door in open position when any shelf is in an extended position at least within a predetermined range of extension from its position within the cabinet to prevent closing the door against a shelf.

10 Claims, 6 Drawing Figures

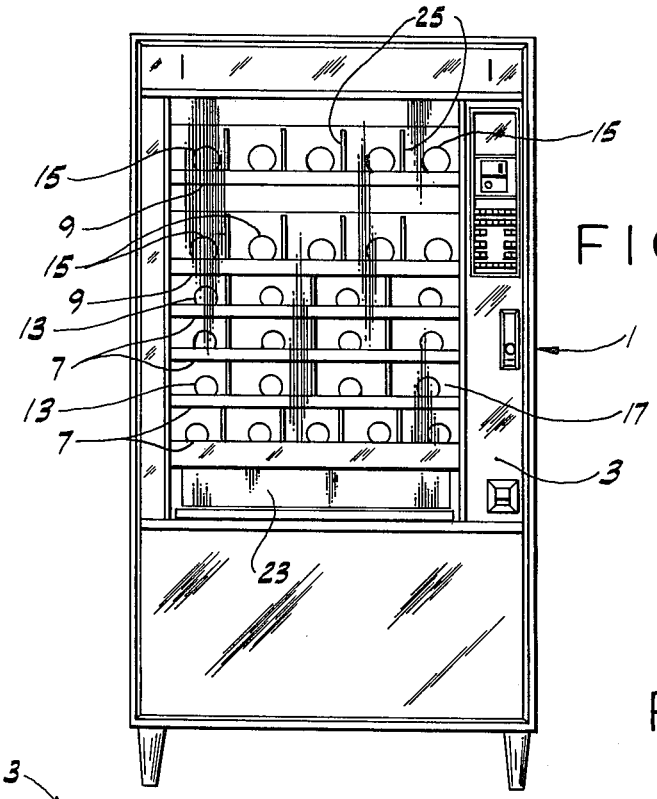
FIG. 1
FIG. 2
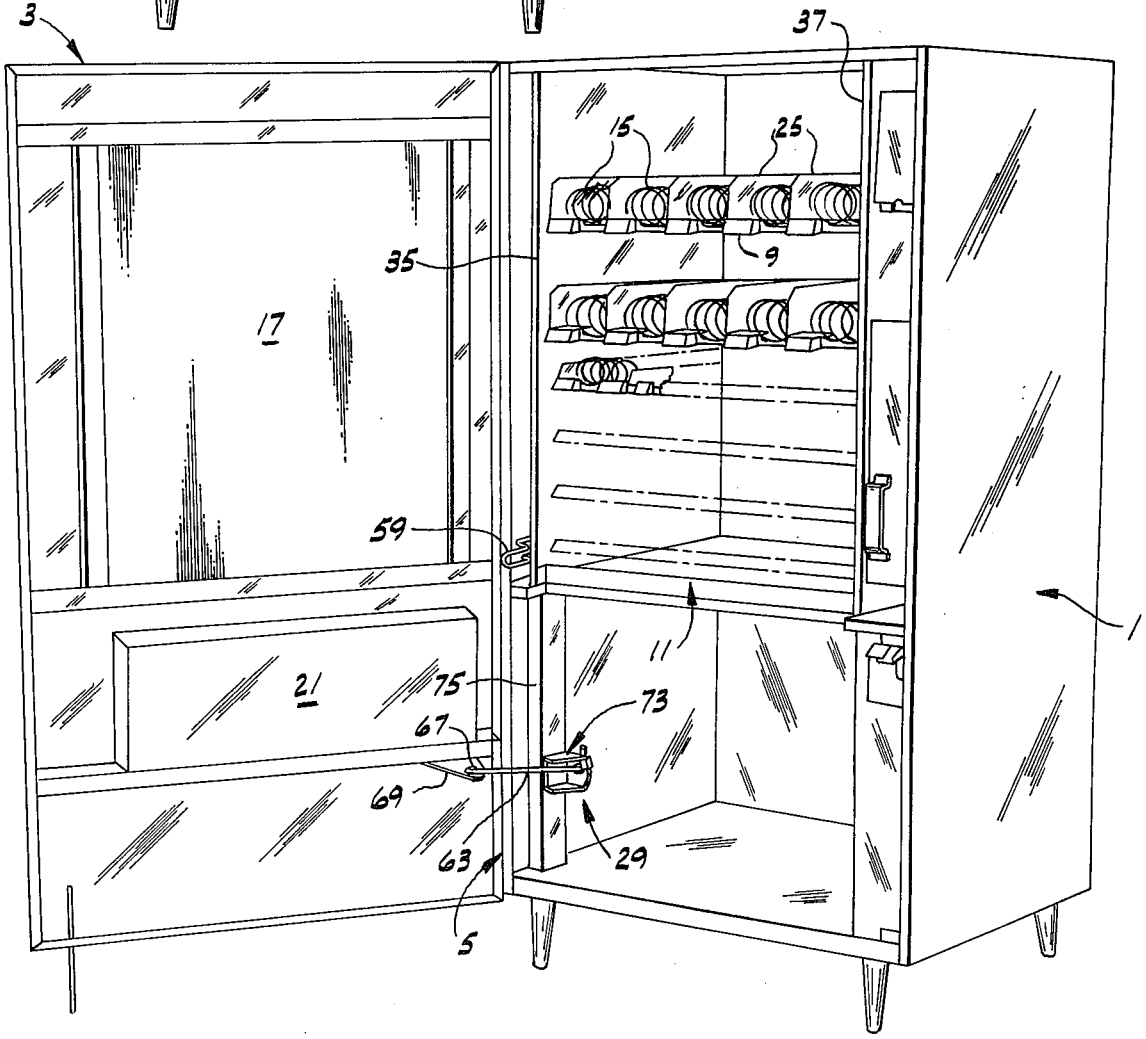

VENDOR WITH DOOR AND SHELF INTERLOCK

CROSS REFERENCE TO RELATED APPLICATION:

This is a continuation of application Ser. No. 511,986, filed Oct. 4, 1974, now abandoned.

BACKGROUND OF THE INVENTION

This invention relates to vendors, and more particularly to a vendor of the type comprising a cabinet having a front door and shelves in the cabinet for holding items to be vended, the shelves having a vending position within the cabinet with the door closed, and being slidable forward to a loading position extending forward from the cabinet when the door is open (and being further slidable forward to remove them from the cabinet, if so desired).

The invention is especially concerned with a spiral vendor of the rear-to-front type, such as is shown in U.S. Pat. Nos. 3,178,055, 3,269,595, 3,344,953, 3,591,045, 3,653,540 and 3,773,217, comprising a cabinet having a front door, shelves in the cabinet having their forward ends spaced rearward from the door to provide a drop space, helices on the shelves extending in rear-to-front direction with respect to the cabinet and adapted to receive items to be vended between their convolutions, the door having a window for viewing the forwardmost items, and means for rotating each helix to advance the items in the convolutions of the helix toward the forward end of the respective shelf and discharge the forwardmost item off the forward end of the shelf to drop down in said drop space.

Rear-to-front spiral vendors such as above described have come into use for vending candy, gum and mints and so-called snack products, including bags of potato chips, pretzels and the like. In such vendors, it is generally desirable to facilitate loading of the shelves by mounting them in the cabinet to be slidable forward from a vending position within the cabinet to a loading position extending forward from the cabinet when the front door of the cabinet is opened, and also that the shelves be further slidable forward to remove them from the cabinet, if so desired. A careless serviceman, however, may slide a shelf forward without having fully opened the door, resulting in the shelf striking the door and causing damage. He may also swing the door to close it without having pushed all the shelves all the way back into the cabinet, resulting in the door striking or shelves and causing damage.

SUMMARY OF THE INVENTION

Accordingly, among the several objects of this invention may be noted the provision of a vendor such as above described with a front door and slide-in slide-out shelves wherein the shelves cannot be said out unless the door is opened far enough to enable the shelves to be slid out without striking the door; and the provision of such a vendor wherein the door is maintained locked in its open position if any shelf is in an extended position at least within a predetermined range of extension from its position within the cabinet.

In general, the invention involves, in a vendor comprising a cabinet having a front door, shelves in the cabinet for holding items to be vended, means for dispensing items from the shelves, means mounting the shelves for sliding movement in rear-to-front direction with respect to the cabinet for sliding out the shelves from a position within the cabinet when the door is open, the improvement comprising the provision of means for locking the shelves in the cabinet to prevent them from being slid out unless the door is opened far enough to enable the shelves to be slid out without striking the door, and means for locking the door is open position when any shelf is in an extended position at least within a predetermined range of extension from its position within the cabinet to prevent closing the door against a shelf.

Other objects and features will be in part apparent and in part pointed out hereinafter.

BRIEF DESCRIPTION OF THE DRAWINGS

FIG. 1 is a front elevation of a vendor in which the present invention is incorporated;

FIG. 2 is a perspective of the vendor with its front door open;

Corresponding reference characters indicate corresponding parts throughout the several views of the drawings.

DESCRIPTION OF THE PREFERRED EMBODIMENT

Figure 3:
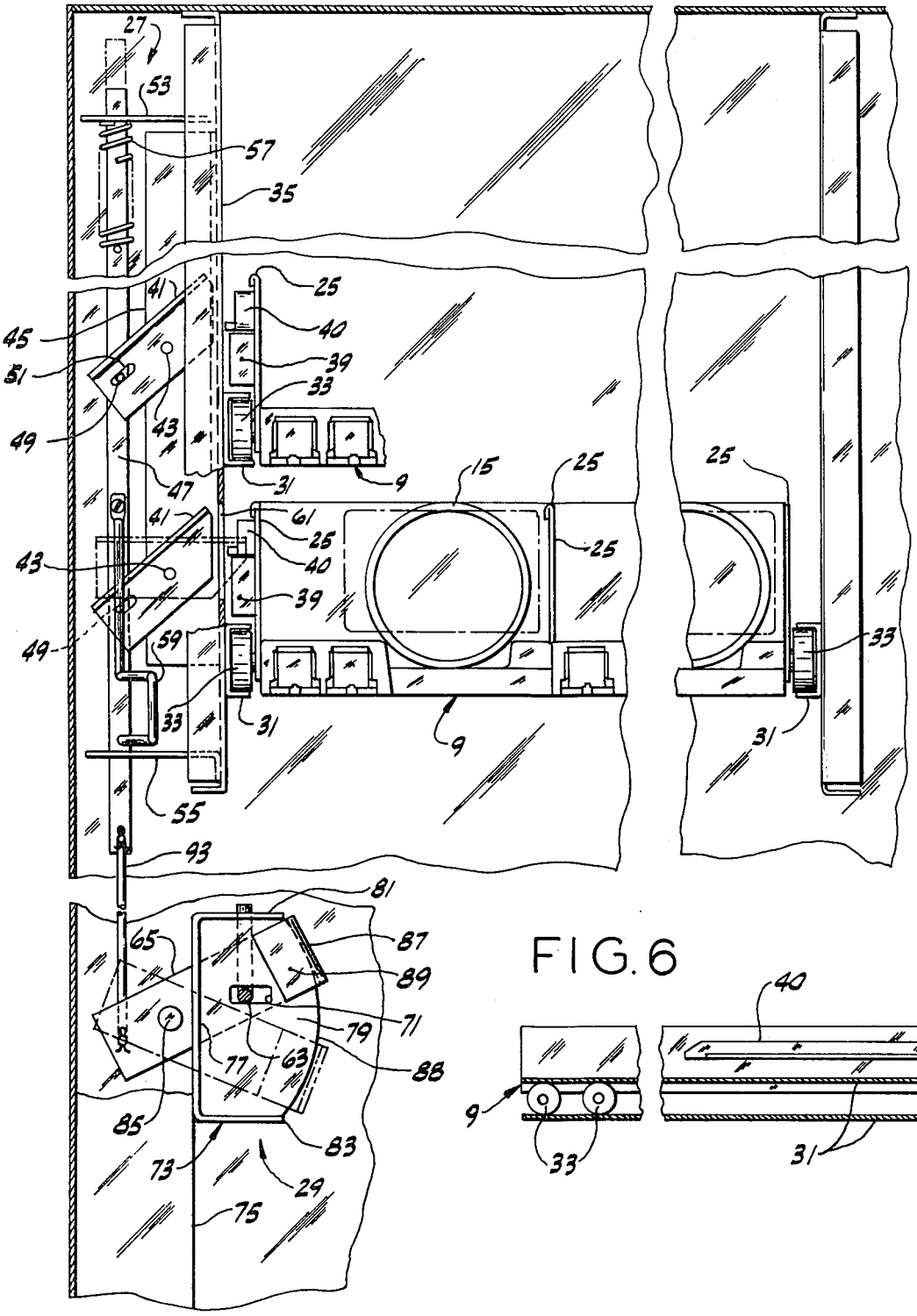
FIG. 3 is a view in elevation showing certain shelves of the vendor and locking mechanism for the shelves and the door of the vendor, with parts broken away and shown in section.

Referring to the drawings, a vendor incorporating the present invention is shown generally to comprise a cabinet 1 having a front door 3 hinged at the left as indicated at 5 in FIG. 2. Within the cabinet there are a plurality of shelves or trays, one above another for bolding items to be vended. As shown there are six shelves, of which the four lower shelves, each designated 7, are for dispensing candy, gum and mints and the upper two shelves, each designated 9, are for dispensing snacks. Generally, the term "snack" refers to a bagged item such as chips (e.g., potato chips), pretzels and the like; "candy" refers to roll type packages of mints. Means is provided mounting each shelf for sliding movement in rear-to-front direction into and out of the cabinet. Each shelf, when slid into the cabinet, has an operative or vending position within the cabinet wherein, with the door 3 closed, the forward end of each shelf is spaced rearward from the door 3 to provide a drop space 11. Each shelf is slidable forward to a loading position extending from the cabinet when the door 3 is open, and may be removed by sliding it all the way out, if so desired.

Each shelf has means for dispensing items therefrom comprising a plurality of helices thereon, each helix extending in rear-to-front direction with respect to the cabinet. Each helix on each of the shelves 7 is designated 13 and is adapted to receive candy, gum or mints between its convolutions. Each helix on each of the shelves 9 is designated 15. It is adapted to receive items B to be vended, such as bags of chips, between its convolutions. The door 5 has a window 17 for viewing the forwardmost items. Means such as indicated at 19 in FIG. 3 is provided for rotating each helix to advance the items loaded between its convolutions toward the forward end of the respective shelf and discharge the forwardmost item off the forward end of the shelf to drop down in said drop space 11 to a delivery pan 21 from which it may be taken out by the customer by pushing in a delivery door 23 in the door 3 below the window 17. Each shelf also has guides 25 extending in rear-to-front direction at opposite sides of each helix defining a rear-to-front path of travel for the items loaded between the convolutions of the helix.

In accordance with this invention, means indicated generally at 27 is provided for locking the shelves in their vending position in the cabinet unless the door 3 is opened to a position enabling the shelves to be slid out without striking the door, and means indicated generally at 29 is provided for locking the door on its said open position when any shelf is in an extended position at least within a predetermined range of extension from its position within the cabinet to prevent closing the door against a shelf.

Figure 6:
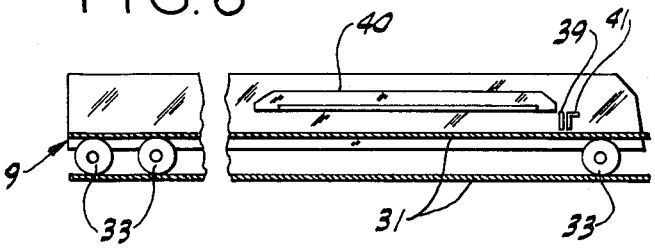
FIG. 6 is a vertical section on line 6—6 of FIG. 3.

More particularly, the means for mounting each of the shelves 7 and 9 for sliding movement into and out of the cabinet comprises a pair of channel-section tracks 31 at opposite sides of the cabinet, the shelf having rollers 33 rolling in these tracks, the arrangement being such that each shelf may be slid out of the front of the cabinet when the door 3 is open to extend in cantilever fashion from its tracks in position for convenient loading of the helices on the shelf. The tracks are mounted on left and right partitions 35 and 37 extending in rear-to-front direction in the cabinet adjacent its left and right sides. The means 27 for locking the shelves in their vending position within the cabinet comprises a lug 39 constituting a stop on the left side of each shelf (which is the side of the shelf toward the side of the cabinet on which the door 3 is hinged) adjacent the front of the shelf, and latch means comprising a vertical series of the latches 41, one for each shelf, movable between a latching position (shown in phantom in FIG. 3) in front of the stop 39 of the respective shelf to prevent the shelf from being pulled out from its vending position within the cabinet, and a retracted position (shown in solid lines in FIG. 3) clear of the stop freeing the shelf to be pulled out. Extending rearward from stop 39 on the left side of each shelf is a holding means constituted by an abutment 40 (see FIGS. 3 and 6) engageable by the respective latch for holding the latch in its retracted position whenever the shelf is pulled out any distance up to the length of the abutment.

As shown in FIG. 3, each latch 41 is pivoted intermediate its ends at 43 for swinging movement between its stated latching and retracted positions on a member 45 extending vertically in the cabinet adjacent the front of the cabinet on the outside of partition 35 (between the partition 35 and the left side wall of the cabinet). The pivotal axes of the latches at 43 extend horizontally in rear-to-front direction. At its outer (left) end, each latch 41 has a pin and slot connection with a latch bar 47 which is mounted for vertical reciprocation in the space between the partition 35 and the left side wall of the cabinet in holes in upper and lower members 53 and 55 on the outside of partition 35. The pin of the connection is indicated at 49 and the slot at 51. The latch bar 47 is biased to move downwardly by spring means such as indicated at 57 in FIG. 3 to swing the latches 41 up to their retracted position, and has a handle 59 for raising it against the spring bias to swing the latches 41 down to their latching position. The latches 41 are swingable through slots 61 provided therefor in the partition 35.

The means 29 for locking the door 3 in its open position clear of the shelves comprises a member 63 movable with the door and latch means constituted by a latch 65 mounted in the cabinet for movement between a retracted or unlatching position clear of member 63 to permit the door to be closed and a latching position engageable by by member 63 for latching door in its open position. Member 63 comprises a rod having a pivotal connection on a vertical axis at 67 with a lug 69 on the inside of the door below the level of the lowermost shelf 7. The rod 63 extends horizontally from the door through a horizontal slot 71 (see FIG. 3) in a bracket 73 mounted in the cabinet adjacent its left side wall on a vertical strut 75 secured to said wall. The bracket has a vertical leg 77 secured to the strut, a vertical leg 79 extending out from the strut at right angles to leg 77 at the rear of the strut, and top and bottom webs 81 and 83. Slot 71 is in leg 79. Latch 65 is pivoted intermediate its ends at 85 on the back of the strut 75 for swinging movement on a horizontal axis which extends in rear-to-front direction. It extends from pivot 85 across the back of leg 79 of the bracket 73 and has a flange 87 at its right end extending forward in front of the right edge 88 of leg 79, which is curved on an arc centered in the pivot 85. This flange has a lip 89 extending inwardly in front of the leg 79. The rod 63 has its rearward end bent up to form a finger as indicated at 91, and the latch 65 is spaced from the back of leg 79 of bracket 73 a distance somewhat greater than the width (diameter) of this finger.

A link 93 interconnects the end of the latch 65 on the opposite side of pivot 85 from flange 87 and the lower end of the latch bar 47, the arrangement being such that when the latch bar 47 is in the lowered, shelf-unlatching position (latches 41 raised) illustrated in FIG. 3 to which bar 47 is pushed down by spring 57, the door latch 65 is swung up to the latching position in which it is illustrated in solid lines in FIG. 3 wherein its flange 87 engages the upper web 81 of the brackets 73. This determines the lowered, shelf-unlatching position of the latch bar 47.

Figure 5:
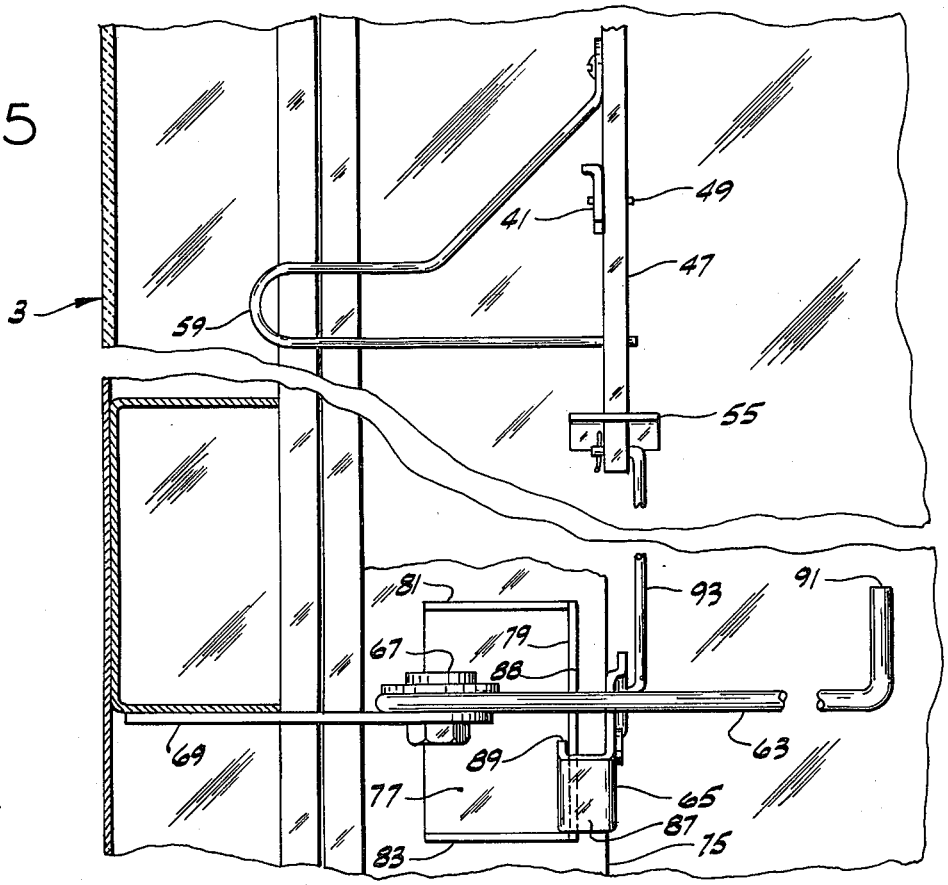
FIG. 5 is a vertical section corresponding to FIG. 4 showing said parts in their position when the door is closed.

When the door 3 is closed, and the shelves 7 and 9 are all in their vending position within the cabinet, the rod 63 occupies the rearward position in which it is shown in FIG. 5 extending through the slot 71 in leg 79 of bracket 73 with finger 91 spaced well to the rear of leg 79. The door latch 65 occupies the retracted door-unlatching position in which it is shown in FIG. 5, and in which it appears in phantom in FIG. 3, lying below the rod 63. The latch bar 17 occupies its raised position in which it is shown in FIG. 5 and in which it appears in phantom in FIG. 3, and the shelf latches 41 are all down in the latching position (shown in phantom for the lowermost latch 4) in FIG. 3 extending in front of stops 39 on the shelves.

Figure 4:
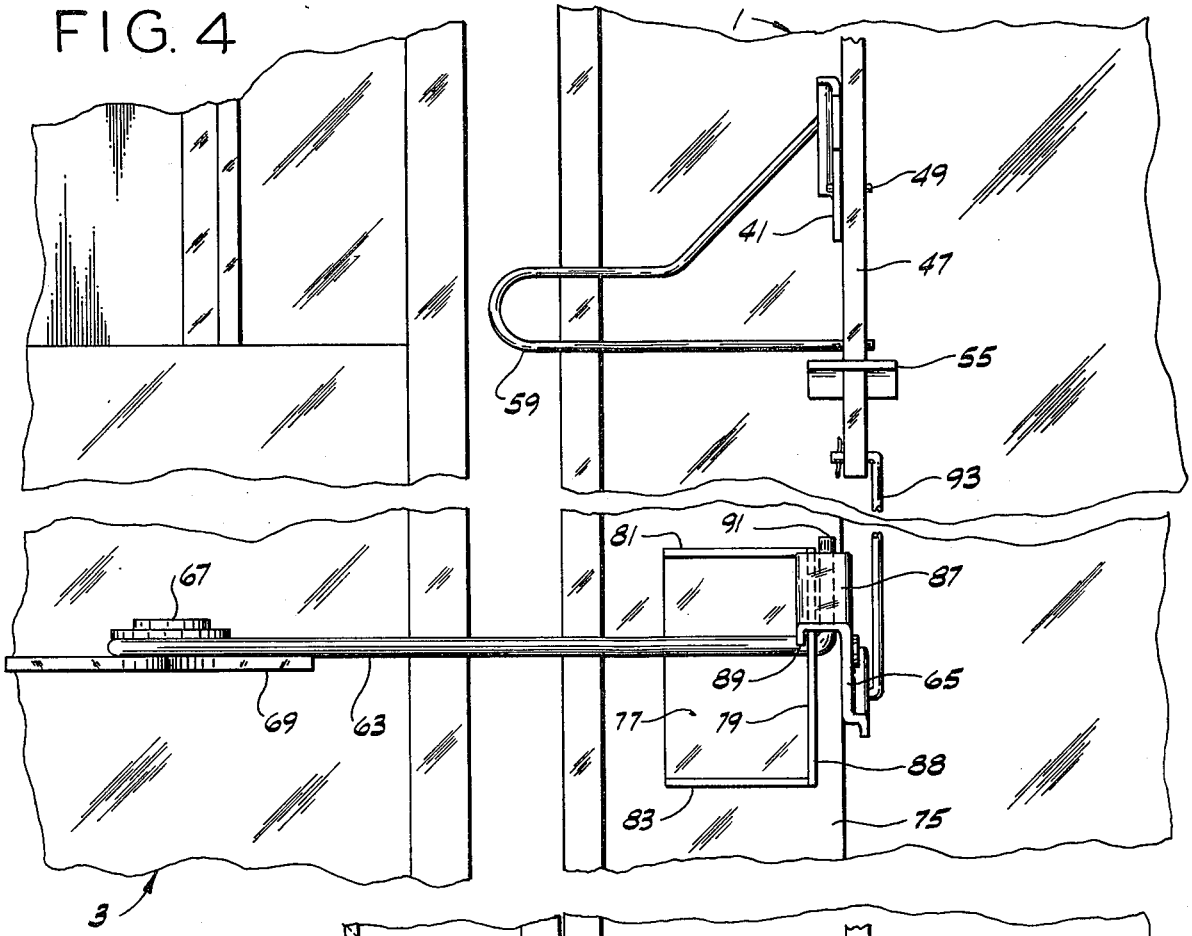
FIG. 4 is a vertical section on line 4—4 of FIG. 3, showing certain parts in their position when the door of the cabinet is open.

When the door 3 is opened, rod 63 is pulled forward (to the left as viewed in FIG. 5) through the slot 71. Assuming the door is swung open all the way to the full-open position such as shown in FIG. 2, in which the shelves may be slid out without striking the door, the rod 63 is pulled forward to the point where finger 91 engages the back of leg 79 of bracket 73 (see FIG. 4). This clears the rod 63 from above the door latch 65 to permit the latter to swing up to its door-latching position, in which it is shown in solid lines in FIG. 3 and 4, under the bias of spring 57 pushing down on the latch bar 47 and acting through the link 93 on the latch 65. The downward movement of the latch bar 47 swings all the shelf latches 41 to their retracted position, in which they are shown in solid lines in FIG. 3, releasing the shelves to be slid out. Since the door is fully open, there is no danger of any shelf striking the door.

If the door 3 is not swung fully open, rod 63 is not pulled forward far enough to release the door latch 65, and the latter remains held down in its lowered position shown in phantom in FIG. 3, so that latch bar 47 remains held up in its phantom position of FIG. 3. Thus, the shelf latches 41 remain down in their latching position shown in phantom in FIG. 3 to prevent the shelves from being slid out.

The door latch 65 is adapted to be released (i.e., swung down) to release the rod 63 to enable the door to be closed by pushing up the latch bar 45 by means of the handle 59 (which extends forward from bar 47 out from between partition 35 and the left side wall of the cabinet). However, bar 47 can be moved up for this purpose only if the shelf latches 41 are free to swing down from their solid-line to their phantom positions of FIG. 3. If any shelf is in any extended position within the range of extending from its vending position in the cabinet to the extended position determined by the length of abutment 40, the latch 41 for that shelf is blocked by engagement with the abutment 40 from swinging down, and this blocks out release of the door latch 65 to prevent the door from being closed. Thus, when any shelf is in an extended position at least within said predetermined range of extension, the door is prevented from being closed and striking a shelf. The abutment 40 could extend completely to the rear end of the shelf to prevent the door from being closed if the shelf is in any extended position, but it has been found practical to use a shorter abutment, for purposes of economy. For example, in the case of a shelf about twenty-four inches long, it has been found satisfactory to use an abutment about eight inches long. A serviceman will rarely be so careless as not to slide the shelves in to within eight inches of their vending position. In this instance, the stated predetermined range of extension in which the door is locked is about eight inches from its vending position within the cabinet. Thus, the primary concern is that the serviceman may carelessly not push every shelf all the way in, but leave one or more shelves extending out up to 8 inches from its vending position within the cabinet. With 8-inch abutments, the door may be closed if the shelves are extended more than 8 inches, but the risk that a serviceman will not notice a shelf extended more than eight inches and slam the door on it is minimal. And, as above noted, the risk may be completely eliminated, by using longer abutments 40 if the added cost is deemed warranted.

In view of the above, it will be seen that the several objects of the invention are achieved and other advantageous results attained.

As various changes could be made in the above constructions without departing from the scope of the invention, it is intended that all matter contained in the above description or shown in the accompanying drawings shall be interpreted as illustrative and not in a limiting sense.

What is claimed is:

1. In a vendor comprising a cabinet having a front door, a plurality of shelves in the cabinet for holding items to be vended, each shelf being mounted for sliding movement in rear-to-front direction for being slid out from a vending position within the cabinet to a loading position extending forward from the cabinet when the door is opened, and means for dispensing items from the shelves: means for locking the shelves in said vending position within the cabinet comprising latch means movable between a position for latching the shelves in said vending position and a retracted position freeing the shelves to be pulled out, holding means on each shelf engageable by the latch means when the shelf is pulled out to any extended position within a predetermined range of extension from its vending position for holding the latch means in retracted position, means for locking the door in an open position wherein the door is open to the extent of enabling the shelves to be slid out without striking the door comprising latch means movable between a position for latching the door in its said open position and a door unlatching position, said shelf latch means and said door latch means being so interconnected for movement one with the other that the shelf latch means must move out of its said retracted position toward its shelf latching position for the door latch means to move to its door unlatching position, said door latch means thereby being held in its door latching position by engagement of the shelf latch means with said holding means on any shelf which is in said extended position whereby the door is latched in its open position and thereby prevented from being closed and striking said shelf.

2. A vendor as set forth in claim 1 wherein the door is hinged at one side of the cabinet to swing open and closed, and the shelf latch means and the door latch means are at said side of the cabinet.

3. A vendor as set forth in claim 2 wherein said means for locking the door comprises a member extending from the door and movable with the door as the door swings open and closed, said member being engageable with the door latch means when the latter is in its door latching position to prevent the door from being closed.

4. A vendor as set forth in claim 2 wherein the shelf latch means comprises a series of latches, one for each shelf, each of said latches being movable between a retracted position and a position for latching the respective shelf in said vending position, and wherein each shelf has means thereon at said side of the cabinet engageable with the respective shelf latch when the latter is in its latching position to latch the shelf in vending position.

5. A vendor as set forth in claim 4, having a latch bar interconnecting the shelf latches, the door latch means being interconnected with the latch bar.

6. A vendor as set forth in claim 5 wherein each shelf latch is pivoted intermediate its ends at said side of the cabinet, one end of each shelf latch being engageable by the stop on the respective shelf, and the latch bar having connections with the other ends of the shelf latches.

7. A vendor as set forth in claim 6 wherein the means on each shelf engageable with the respective shelf latch comprises a stop on the side of the shelf at said side of the cabinet, and the holding means comprises an abutment on said side of the shelf extending rearward from said stop.

8. A vendor as set forth in claim 6 wherein said means for locking the door comprises a member extending from the door and movable with the door as the door swings open and closed, said member being engageable with the door latch means when the latter is in its door latching position to prevent the door from being closed.

9. A vendor as set forth in claim 8 wherein said door latch means comprises a door latch pivoted at said side of the cabinet, said member being engageable with said door latch when the latter is in its door latching position and the door is swung in from its open position.

10. A vendor as set forth in claim 9 having a link interconnecting the door latch and the latch bar, and means biasing the latch bar to swing the shelf latches to retracted position and the door latch to door latching position, the latch bar being adapted manually to be raised to retract the door latch.

* * * * *